US009778606B2

(12) United States Patent
Seki et al.

(10) Patent No.: US 9,778,606 B2
(45) Date of Patent: Oct. 3, 2017

(54) FIXING DEVICE AND IMAGE FORMING APPARATUS

(71) Applicants: Takayuki Seki, Kanagawa (JP); Susumu Matsusaka, Kanagawa (JP); Yasuhiko Ogino, Kanagawa (JP); Shohta Kobashigawa, Tokyo (JP); Kenji Ishii, Kanagawa (JP); Kazuhito Kishi, Kanagawa (JP); Takashi Seto, Kanagawa (JP); Ippei Fujimoto, Kanagawa (JP); Kazunari Sawada, Tokyo (JP); Hiroshi Yoshinaga, Chiba (JP)

(72) Inventors: Takayuki Seki, Kanagawa (JP); Susumu Matsusaka, Kanagawa (JP); Yasuhiko Ogino, Kanagawa (JP); Shohta Kobashigawa, Tokyo (JP); Kenji Ishii, Kanagawa (JP); Kazuhito Kishi, Kanagawa (JP); Takashi Seto, Kanagawa (JP); Ippei Fujimoto, Kanagawa (JP); Kazunari Sawada, Tokyo (JP); Hiroshi Yoshinaga, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/011,982

(22) Filed: Feb. 1, 2016

(65) Prior Publication Data

US 2016/0238975 A1 Aug. 18, 2016

(30) Foreign Application Priority Data

Feb. 12, 2015 (JP) ..... 2015-025271
Dec. 16, 2015 (JP) ..... 2015-245000

(51) Int. Cl.
*G03G 15/20* (2006.01)

(52) U.S. Cl.
CPC ..... *G03G 15/2053* (2013.01); *G03G 15/2064* (2013.01)

(58) Field of Classification Search
None
See application file for complete search history.

(56) References Cited

U.S. PATENT DOCUMENTS

2003/0190170 A1* 10/2003 Hamada ..... G03G 15/205 399/69
2007/0292175 A1 12/2007 Shinshi
(Continued)

FOREIGN PATENT DOCUMENTS

AP 2013-137470 7/2013
AP 2014-240952 12/2014
(Continued)

OTHER PUBLICATIONS

Nakayama, JP 2010078839 English machine translation, Apr. 8, 2010.*

*Primary Examiner* — Thomas Giampaolo, II
(74) *Attorney, Agent, or Firm* — Oblon, McClelland, Maier & Neustadt, L.L.P.

(57) ABSTRACT

A fixing device includes a first heater and a second heater disposed inside a fixing rotator to heat the fixing rotator. The first heater generates an increased amount of heat and includes a first heat generator having a first heating span in a longitudinal direction of the first heater. The second heater generates a decreased amount of heat and includes a second heat generator having a second heating span in a longitudinal direction of the second heater. A partition is interposed between the first heater and the second heater to define a first compartment having an increased size and accommodating the first heater and a second compartment having a decreased size and accommodating the second heater.

19 Claims, 6 Drawing Sheets

(56) References Cited

U.S. PATENT DOCUMENTS

| | | | | |
|---|---|---|---|---|
| 2009/0028590 | A1* | 1/2009 | Nanataki | G03G 15/2042 399/44 |
| 2011/0058864 | A1 | 3/2011 | Fujimoto et al. | |
| 2011/0211876 | A1* | 9/2011 | Iwaya | G03G 15/2085 399/323 |
| 2012/0008971 | A1* | 1/2012 | Lee | G03G 15/2064 399/69 |
| 2013/0170879 | A1 | 7/2013 | Yoshinaga et al. | |
| 2013/0183071 | A1 | 7/2013 | Iwaya et al. | |
| 2013/0251430 | A1 | 9/2013 | Fujimoto et al. | |
| 2014/0079453 | A1 | 3/2014 | Arai et al. | |
| 2014/0341627 | A1 | 11/2014 | Yoshikawa et al. | |
| 2014/0356036 | A1 | 12/2014 | Shimokawa et al. | |
| 2014/0356037 | A1 | 12/2014 | Shimokawa et al. | |
| 2015/0185671 | A1 | 7/2015 | Ikebuchi et al. | |
| 2015/0355586 | A1 | 12/2015 | Fujimoto et al. | |

FOREIGN PATENT DOCUMENTS

| | | |
|---|---|---|
| JP | 4-044083 | 2/1992 |
| JP | 2004-286922 | 10/2004 |
| JP | 2007-310220 | 11/2007 |
| JP | 2007-310244 | 11/2007 |
| JP | 2007-334205 | 12/2007 |
| JP | 2010-078839 | 4/2010 |
| JP | 2010-276785 | 12/2010 |
| JP | 2011-237831 | 11/2011 |
| JP | 2013-145288 | 7/2013 |
| JP | 2014-041172 | 3/2014 |
| JP | 2014-056146 | 3/2014 |
| JP | 2014-056203 | 3/2014 |

* cited by examiner

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2015-025271, filed on Feb. 12, 2015, and 2015-245000, filed on Dec. 16, 2015, in the Japanese Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and a pressure rotator disposed opposite the fixing rotator to form a fixing nip therebetween, through which a recording medium bearing a toner image is conveyed. A first heater is disposed inside the fixing rotator to generate an increased amount of heat to heat the fixing rotator. The first heater includes a first heat generator having a first heating span in a longitudinal direction of the first heater. A second heater is disposed inside the fixing rotator to generate a decreased amount of heat to heat the fixing rotator. The second heater includes a second heat generator having a second heating span in a longitudinal direction of the second heater. A partition is interposed between the first heater and the second heater to define a first compartment having an increased size and accommodating the first heater and a second compartment having a decreased size and accommodating the second heater.

This specification further describes an improved image forming apparatus. In one exemplary embodiment, the image forming apparatus includes an image bearer to bear a toner image and a fixing device disposed downstream from the image bearer in a recording medium conveyance direction to fix the toner image on a recording medium. The fixing device includes a fixing rotator rotatable in a predetermined direction of rotation and a pressure rotator disposed opposite the fixing rotator to form a fixing nip therebetween, through which the recording medium bearing the toner image is conveyed. A first heater is disposed inside the fixing rotator to generate an increased amount of heat to heat the fixing rotator. The first heater includes a first heat generator having a first heating span in a longitudinal direction of the first heater. A second heater is disposed inside the fixing rotator to generate a decreased amount of heat to heat the fixing rotator. The second heater includes a second heat generator having a second heating span in a longitudinal direction of the second heater. A partition is interposed between the first heater and the second heater to define a first compartment having an increased size and accommodating the first heater and a second compartment having a decreased size and accommodating the second heater.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
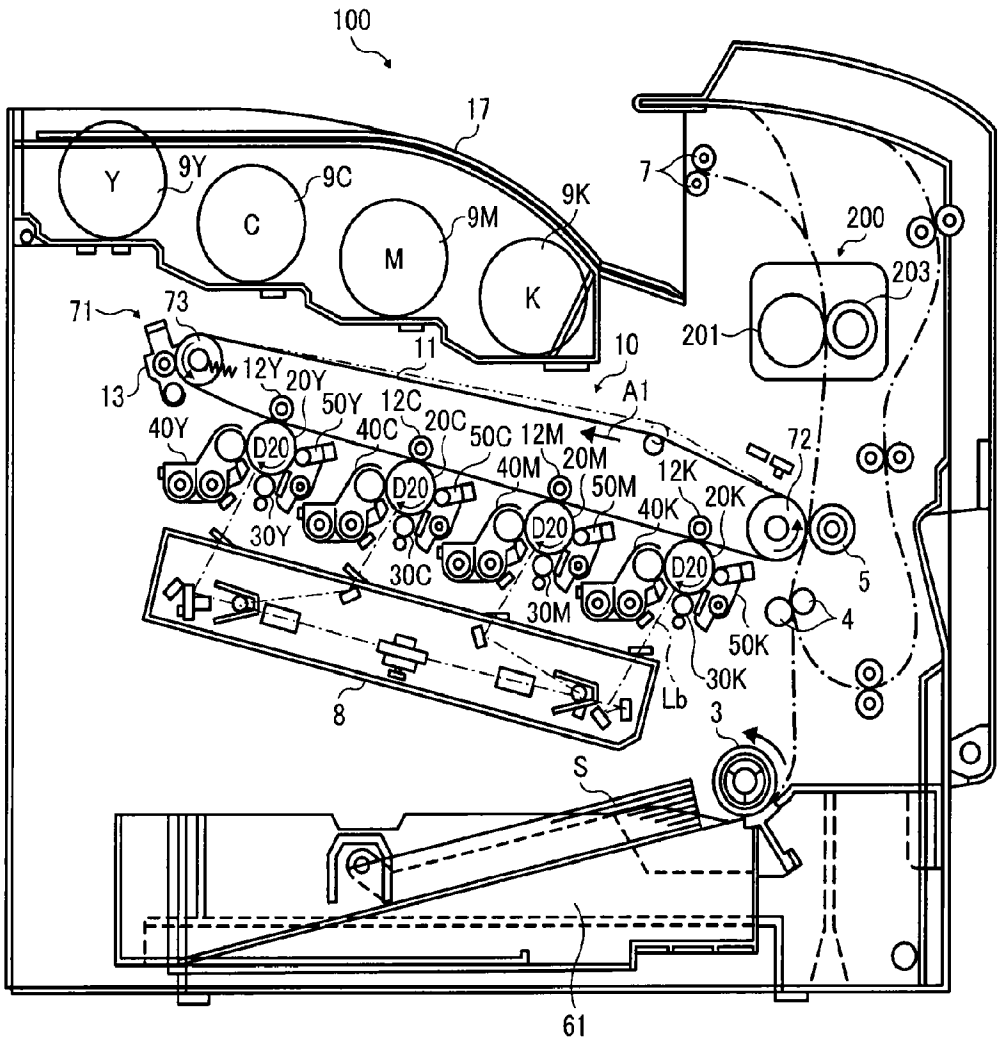
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 100 is a color printer that forms color and monochrome toner images on a recording medium by electrophotography. Alternatively, the image forming apparatus 100 may be a monochrome printer that forms a monochrome toner image on a recording medium.

With reference to FIG. 1, a description is provided of a construction of the image forming apparatus 100.

The image forming apparatus 100 is a color printer employing a tandem system in which a plurality of image forming devices for forming toner images in a plurality of colors, respectively, is aligned in a rotation direction of a transfer belt. Alternatively, the image forming apparatus 100 may employ other systems.

The image forming apparatus 100 employs a tandem structure in which four photoconductive drums 20Y, 20C, 20M, and 20K serving as image bearers that bear yellow, cyan, magenta, and black toner images in separation colors, respectively, are aligned.

The yellow, cyan, magenta, and black toner images formed on the photoconductive drums 20Y, 20C, 20M, and 20K, respectively, are primarily transferred successively onto an endless transfer belt 11 serving as an intermediate transferor disposed opposite the photoconductive drums 20Y, 20C, 20M, and 20K as the transfer belt 11 rotates in a rotation direction A1 such that the yellow, cyan, magenta, and black toner images are superimposed on a same position on the transfer belt 11 in a primary transfer process. Thereafter, the yellow, cyan, magenta, and black toner images superimposed on the transfer belt 11 are secondarily transferred onto a recording medium S (e.g., a recording sheet) collectively in a secondary transfer process.

Each of the photoconductive drums 20Y, 20C, 20M, and 20K is surrounded by image forming components that form the yellow, cyan, magenta, and black toner images on the photoconductive drums 20Y, 20C, 20M, and 20K as they rotate clockwise in FIG. 1 in a rotation direction D20. Taking the photoconductive drum 20K that forms the black toner image, the following describes an image forming operation to form the black toner image. The photoconductive drum 20K is surrounded by a charger 30K, a developing device 40K, a primary transfer roller 12K, and a cleaner 50K in this order in the rotation direction D20 of the photoconductive drum 20K. The photoconductive drums 20Y, 20C, and 20M are also surrounded by chargers 30Y, 30C, and 30M, developing devices 40Y, 40C, and 40M, primary transfer rollers 12Y, 12C, and 12M, and cleaners 50Y, 50C, and 50M in this order in the rotation direction D20 of the photoconductive drums 20Y, 20C, and 20M, respectively. After the charger 30K charges the photoconductive drum 20K, an optical writing device 8 writes an electrostatic latent image on the photoconductive drum 20K with a laser beam Lb.

As the transfer belt 11 rotates in the rotation direction A1, the yellow, cyan, magenta, and black toner images formed on the photoconductive drums 20Y, 20C, 20M, and 20K, respectively, are primarily transferred successively onto the transfer belt 11, thus being superimposed on the same position on the transfer belt 11. In the primary transfer process, the primary transfer rollers 12Y, 12C, 12M, and 12K disposed opposite the photoconductive drums 20Y, 20C, 20M, and 20K via the transfer belt 11, respectively, apply a primary transfer bias to the photoconductive drums 20Y, 20C, 20M, and 20K successively from the upstream photoconductive drum 20Y to the downstream photoconductive drum 20K in the rotation direction A1 of the transfer belt 11.

The photoconductive drums 20Y, 20C, 20M, and 20K are aligned in this order in the rotation direction A1 of the transfer belt 11. The photoconductive drums 20Y, 20C, 20M, and 20K are located in four image forming stations that form the yellow, cyan, magenta, and black toner images, respectively.

The image forming apparatus 100 includes the four image forming stations, a transfer belt unit 10, a secondary transfer roller 5, a belt cleaner 13, and the optical writing device 8. The transfer belt unit 10 is situated above and disposed opposite the photoconductive drums 20Y, 20C, 20M, and 20K. The transfer belt unit 10 incorporates the transfer belt 11 and the primary transfer rollers 12Y, 12C, 12M, and 12K. The secondary transfer roller 5 is disposed opposite the transfer belt 11 and driven and rotated in accordance with rotation of the transfer belt 11. The belt cleaner 13 is disposed opposite the transfer belt 11 to clean the transfer belt 11. The optical writing device 8 is situated below and disposed opposite the four image forming stations.

The optical writing device 8 includes a semiconductor laser serving as a light source, a coupling lens, an fθ lens, a troidal lens, a deflection mirror, and a rotatable polygon mirror serving as a deflector. The optical writing device 8 emits light beams Lb corresponding to the yellow, cyan, magenta, and black toner images to be formed on the photoconductive drums 20Y, 20C, 20M, and 20K thereto, forming electrostatic latent images on the photoconductive drums 20Y, 20C, 20M, and 20K, respectively. FIG. 1 illustrates the light beam Lb irradiating the photoconductive drum 20K. Similarly, light beams Lb irradiate the photoconductive drums 20Y, 20C, and 20M, respectively.

The image forming apparatus 100 further includes a sheet feeder 61 and a registration roller pair 4. The sheet feeder 61 incorporates a paper tray that loads a plurality of recording media S to be conveyed to a secondary transfer nip formed between the transfer belt 11 and the secondary transfer roller 5. The registration roller pair 4 conveys a recording medium S conveyed from the sheet feeder 61 to the secondary transfer nip formed between the transfer belt 11 and the secondary transfer roller 5 at a predetermined time when the yellow, cyan, magenta, and black toner images superimposed on the transfer belt 11 reach the secondary transfer nip. The image forming apparatus 100 further includes a sensor that detects a leading edge of the recording medium S as it reaches the registration roller pair 4.

The image forming apparatus 100 further includes a fixing device 200, an output roller pair 7, an output tray 17, and toner bottles 9Y, 9C, 9M, and 9K. The fixing device 200, serving as a fusing unit employing a belt fixing system, fixes a color toner image formed by the yellow, cyan, magenta, and black toner images secondarily transferred from the transfer belt 11 onto the recording medium S thereon. The output roller pair 7 ejects the recording medium S bearing the fixed toner image onto an outside of the image forming apparatus 100, that is, the output tray 17. The output tray 17 is disposed atop the image forming apparatus 100 and stacks the recording medium S ejected by the output roller pair 7. The toner bottles 9Y, 9C, 9M, and 9K are situated below the output tray 17 and replenished with fresh yellow, cyan, magenta, and black toners, respectively.

The transfer belt unit 10 includes a driving roller 72 and a driven roller 73 over which the transfer belt 11 is looped, in addition to the transfer belt 11 and the primary transfer rollers 12Y, 12C, 12M, and 12K.

Since the driven roller 73 also serves as a tension applicator that applies tension to the transfer belt 11, a biasing member (e.g., a spring) biases the driven roller 73 against the transfer belt 11. The transfer belt unit 10, the primary transfer rollers 12Y, 12C, 12M, and 12K, the secondary transfer roller 5, and the belt cleaner 13 constitute a transfer device 71.

The sheet feeder 61 is situated in a lower portion of the image forming apparatus 100 and includes a feed roller 3 that contacts an upper side of an uppermost recording medium S of the plurality of recording media S loaded on the paper tray of the sheet feeder 61. As the feed roller 3 is driven and rotated counterclockwise in FIG. 1, the feed roller 3 feeds the uppermost recording medium S to the registration roller pair 4.

The belt cleaner 13 of the transfer device 71 includes a cleaning brush and a cleaning blade disposed opposite and contacting the transfer belt 11. The cleaning brush and the cleaning blade scrape a foreign substance such as residual toner particles off the transfer belt 11, removing the foreign substance from the transfer belt 11 and thereby cleaning the transfer belt 11.

The belt cleaner 13 further includes a waste toner conveyer that conveys the residual toner particles removed from the transfer belt 11.

Figure 2:
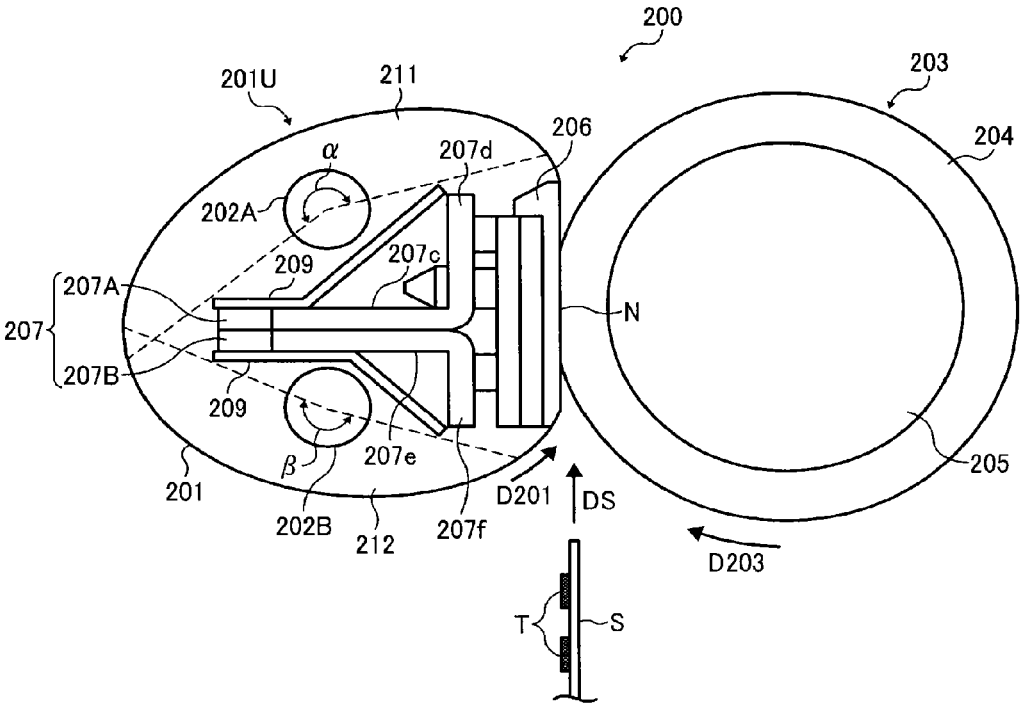
FIG. 2 is a schematic vertical sectional view of a fixing device according to a first exemplary embodiment that is incorporated in the image forming apparatus shown in FIG. 1.

With reference to FIG. 2, a description is provided of a construction of the fixing device 200 according to a first exemplary embodiment incorporated in the image forming apparatus 100 described above.

FIG. 2 is a schematic vertical sectional view of the fixing device 200. As shown in FIG. 2, the fixing device 20 (e.g., a fuser or a fusing unit) includes a fixing belt 201 serving as a fixing rotator or an endless belt formed into a loop and rotatable in a rotation direction D201; a pressure roller 203 serving as a pressure rotator disposed opposite an outer circumferential surface of the fixing belt 201 to separably or unseparably press against the fixing belt 201 and rotatable in a rotation direction D203 counter to the rotation direction D201 of the fixing belt 201; a plurality of heaters, that is, a halogen heater 202A serving as a primary heater and a halogen heater 202B serving as a secondary heater, disposed opposite an inner circumferential surface of the fixing belt 201 to heat the fixing belt 201 directly with radiation heat or light irradiating the inner circumferential surface of the fixing belt 201; a nip formation pad 206; a stay 207; and a reflector 209. The fixing belt 201 and the components disposed inside the loop formed by the fixing belt 201, that is, the halogen heaters 202A and 202B, the nip formation pad 206, the stay 207, and the reflector 209, may constitute a belt unit 201U separably coupled with the pressure roller 203. The nip formation pad 206 is disposed inside the loop formed by the fixing belt 201 and presses against the pressure roller 203 via the fixing belt 201 to form a fixing nip N between the fixing belt 201 and the pressure roller 203. As the fixing belt 201 rotates in the rotation direction D201, the inner circumferential surface of the fixing belt 201 slides over the nip formation pad 206 directly or indirectly via a slide sheet (e.g., a low-friction sheet). As a recording medium S bearing a toner image T conveyed by the secondary transfer roller 5 depicted in FIG. 1 passes through the fixing nip N in a recording medium conveyance direction DS, the fixing belt 201 and the pressure roller 203 fix the toner image T on the recording medium S under heat and pressure.

As shown in FIG. 2, the fixing nip N is planar. Alternatively, the fixing nip N may be contoured into a recess or other shapes. If the fixing nip N defines the recess, the recessed fixing nip N directs the leading edge of the recording medium S toward the pressure roller 203 as the recording medium S is ejected from the fixing nip N, facilitating separation of the recording medium S from the fixing belt 201 and suppressing jamming of the recording medium S between the fixing belt 201 and the pressure roller 203.

A detailed description is now given of a construction of the fixing belt 201.

The fixing belt 201 is an endless belt or film made of metal such as nickel and SUS stainless steel or resin such as polyimide. The fixing belt 201 is constructed of a base layer and a release layer. The release layer constituting an outer surface layer is made of tetrafluoroethylene-perfluoroalkylvinylether copolymer (PFA), polytetrafluoroethylene (PTFE), or the like to facilitate separation of toner of the toner image T on the recording medium S from the fixing belt 201. An elastic layer may be sandwiched between the base layer and the release layer and made of silicone rubber or the like. If the fixing belt 201 does not incorporate the elastic layer, the fixing belt 201 has a decreased thermal capacity that improves fixing property of being heated quickly to a desired fixing temperature at which the toner image T is fixed on the recording medium S. However, as the pressure roller 203 and the fixing belt 201 sandwich and press the unfixed toner image T on the recording medium S passing through the fixing nip N, slight surface asperities of the fixing belt 201 may be transferred onto the toner image T on the recording medium S, resulting in variation in gloss of the solid toner image T that may appear as an orange peel image on the recording medium S. To address this circumstance, the elastic layer made of silicone rubber has a thickness not smaller than about 100 micrometers. As the elastic layer deforms, the elastic layer absorbs slight surface asperities of the fixing belt 201, preventing formation of the faulty orange peel image.

A detailed description is now given of a configuration of the stay 207.

The stay 207 serving as a support that supports the nip formation pad 206 to form the fixing nip N is situated inside the loop formed by the fixing belt 201. As the nip formation pad 206 receives pressure from the pressure roller 203, the stay 207 supports the nip formation pad 206 to prevent bending of the nip formation pad 206 and produce an even nip length in the recording medium conveyance direction DS throughout the entire width of the fixing belt 201 in an axial direction thereof. The stay 207 is mounted on and held by flanges serving as a holder at both lateral ends of the stay 207 in a longitudinal direction thereof parallel to the axial direction of the fixing belt 201, respectively, thus being positioned inside the fixing device 200. The reflector 209 interposed between the halogen heaters 202A and 202B and the stay 207 reflects light radiated from the halogen heaters 202A and 202B to the reflector 209 toward the fixing belt 201, preventing the stay 207 from being heated by the halogen heaters 202A and 202B with radiation heat and the like and thereby reducing waste of energy. Alternatively, instead of the reflector 209, an opposed face of the stay 207 disposed opposite the halogen heaters 202A and 202B may be treated with insulation or mirror finish to reflect light radiated from the halogen heaters 202A and 202B to the stay 207 toward the fixing belt 201.

A detailed description is now given of a construction of the pressure roller 203.

The pressure roller 203 is constructed of a cored bar 205, an elastic rubber layer 204 coating the cored bar 205, and a surface release layer coating the elastic rubber layer 204 and made of PFA or PTFE to facilitate separation of the recording medium S from the pressure roller 203. As a driving force generated by a driver (e.g., a motor) situated inside the image forming apparatus 100 depicted in FIG. 1 is transmitted to the pressure roller 203 through a gear train, the pressure roller 203 rotates in the rotation direction D203 as shown in FIG. 2. Alternatively, the driver may also be connected to the fixing belt 201 to drive and rotate the fixing belt 201. A spring or the like presses the pressure roller 203 against the nip formation pad 206 via the fixing belt 201. As the spring presses and deforms the elastic rubber layer 204 of the pressure roller 203, the pressure roller 203 produces the fixing nip N having a predetermined length in the recording medium conveyance direction DS. The pressure roller 203 may be a hollow roller or a solid roller. If the pressure roller 203 is a hollow roller, a heater such as a halogen heater may be disposed inside the hollow roller. The elastic rubber layer 204 may be made of solid rubber. Alternatively, if no heater is situated inside the pressure roller 203, the elastic rubber layer 204 may be made of sponge rubber. The sponge rubber is more preferable than the solid rubber because it has an increased insulation that draws less heat from the fixing belt 201.

As the pressure roller 203 rotates in the rotation direction D203, the fixing belt 201 rotates in the rotation direction D201 in accordance with rotation of the pressure roller 203 by friction therebetween. According to this exemplary embodiment, as the driver drives and rotates the pressure roller 203, a driving force of the driver is transmitted from the pressure roller 203 to the fixing belt 201 at the fixing nip N, thus rotating the fixing belt 201 by friction between the pressure roller 203 and the fixing belt 201. At the fixing nip N, the fixing belt 201 rotates as it is sandwiched between the pressure roller 203 and the nip formation pad 206; at a circumferential span of the fixing belt 20 other than the fixing nip N, the fixing belt 201 rotates as it is guided by the flange at each lateral end of the fixing belt 201 in the axial direction thereof.

With the construction described above, the fixing device 200 attaining quick warm-up is manufactured at reduced costs.

A description is provided of configurations of comparative fixing devices, each of which includes a plurality of heaters, for example, two or three halogen heaters.

The comparative fixing devices are requested to shorten a warm-up time taken to heat a fixing belt to a predetermined fixing temperature, that is, a reload temperature, appropriate for fixing a toner image on a sheet from an ambient temperature after an image forming apparatus incorporating the comparative fixing device is powered on and a first print time taken to output the sheet bearing the fixed toner image upon receipt of a print job through preparation for a print operation and the subsequent print operation.

The comparative fixing devices include the plurality of halogen heaters having different heating spans to achieve different heat or light distributions so as to fix toner images on recording media of various sizes, respectively. For example, the comparative fixing devices may include a first heater having a heat distribution corresponding to a width of an A4 size sheet in portrait orientation (e.g., 210 mm) and a second heater having a heat distribution corresponding to a width of an A4 size sheet in portrait orientation and a width of an A3 size sheet in portrait orientation (e.g., 210 mm to 297 mm).

As the comparative fixing devices are downsized, an endless belt incorporated therein is downsized to have a decreased loop diameter that reduces an interval between the first heater and the second heater disposed inside the loop formed by the endless belt. Accordingly, if the first heater is parallel to the second heater, one of the first heater and the second heater may heat another one of the first heater and the second heater with radiation heat, degrading heating efficiency of the first heater and the second heater.

A detailed description is now given of constructions of the plurality of comparative fixing devices, that is, first to fourth comparative fixing devices.

The first comparative fixing device includes three halogen heaters situated inside a stay collectively. When the three halogen heaters are energized, glass tubes of the halogen heaters heat each other, decreasing an amount of light that irradiates a fixing belt directly and therefore degrading heating efficiency of the halogen heaters. Additionally, the three halogen heaters are substantially surrounded by a reflector that may decrease a radiation amount of light that irradiates the fixing belt and narrow an irradiation angle of light that irradiates the fixing belt, degrading heating efficiency of the halogen heaters.

The second comparative fixing device includes two halogen heaters situated below a stay collectively. When the two halogen heaters are energized, glass tubes of the halogen heaters heat each other, reducing an amount of light that irradiates a fixing belt directly and therefore degrading heating efficiency of the halogen heaters.

Figure 3:
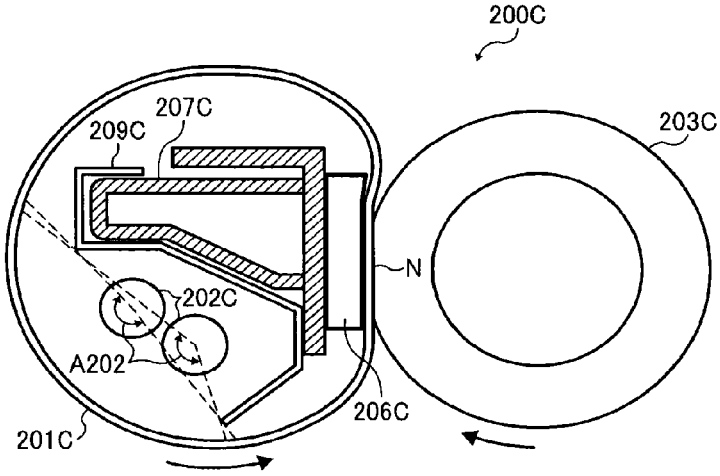
FIG. 3 is a schematic vertical sectional view of a comparative fixing device.

FIG. 3 is a schematic vertical sectional view of a third comparative fixing device 200C incorporating two halogen heaters 202C. The third comparative fixing device 200C includes a pressure roller 203C pressed against a nip formation pad 206C supported by a stay 207C via a fixing belt 201C to form a fixing nip N between the fixing belt 201C and the pressure roller 203C. The two halogen heaters 202C are substantially surrounded by a reflector 209C that may decrease a radiation amount of light that irradiates the fixing belt 201C and narrow an irradiation angle of light that irradiates the fixing belt 201C as shown by irradiation angles A202, degrading heating efficiency of the halogen heaters 202C. The irradiation angle A202 defines an angle formed by light being radiated from the halogen heater 202C and irradiating the fixing belt 201C directly. For example, one of the halogen heaters 202C is a center heater that heats a center span of the fixing belt 201C in an axial direction thereof. Another one of the halogen heaters 202C is a lateral end heater that heats both lateral end spans of the fixing belt 201C in the axial direction thereof.

The fourth comparative fixing device includes two halogen heaters. For example, the fourth comparative fixing device includes a fixing belt, two fixing heaters (e.g., the halogen heaters), a pressure roller, and a reflector. The reflector includes a support extending substantially vertically, an abutment pressing against the pressure roller via the fixing belt, and an irradiation restrictor that changes an irradiation time of light radiated from the fixing heaters to the fixing belt in an axial direction thereof. The reflector divides an interior of the fixing belt into two compartments evenly where the two fixing heaters are situated, respectively. Accordingly, when the fixing heaters are energized, the fixing heaters do not heat glass tubes thereof each other, preventing degradation in heating efficiency of the fixing heaters. Additionally, the two fixing heaters are situated in the two compartments having an identical size and symmetrical with respect to the reflector. Accordingly, the two fixing heaters have an identical irradiation angle of light that is radiated from the fixing heaters and irradiates the fixing belt directly. However, the fourth comparative fixing device may have room for improvement in heating efficiency.

Figure 4:
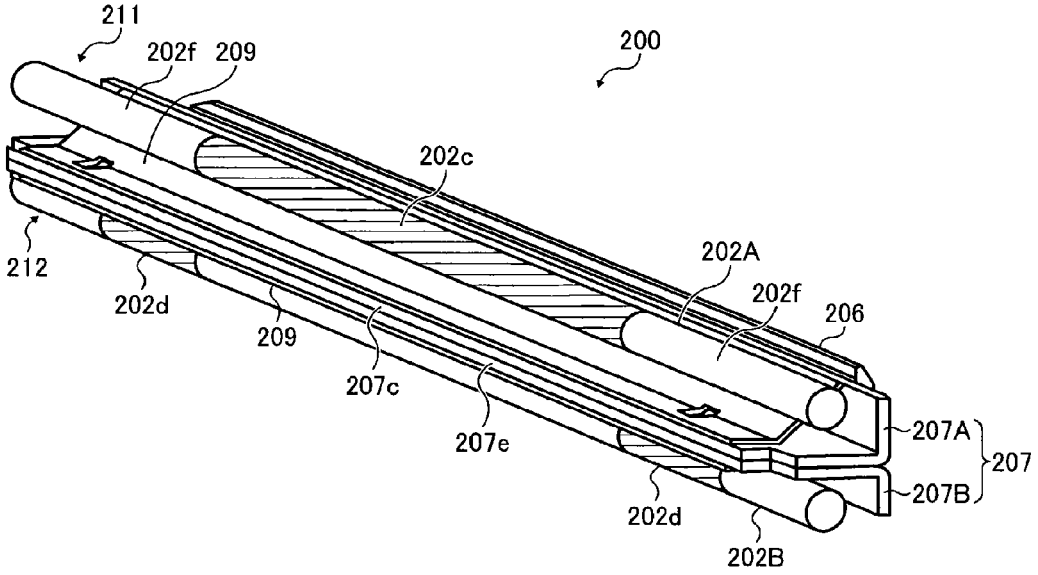
FIG. 4 is a partial schematic perspective view of the fixing device shown in FIG. 2 illustrating an interior of a loop formed by a fixing belt.

To address those circumstances of the comparative fixing devices, the fixing device 200 according to this exemplary embodiment has a configuration described below. As shown in FIG. 2, the stay 207 serving as a partition includes a first part 207A and a second part 207B, each of which is substantially L-shaped in cross-section. The first part 207A includes a first partition 207*c* that screens the halogen heater 202A from the halogen heater 202B and a first mount 207*d* that mounts the nip formation pad 206. Similarly, the second part 207B includes a second partition 207*e* that screens the halogen heater 202B from the halogen heater 202A and a second mount 207*f* that mounts the nip formation pad 206. The first partition 207*c* and the second partition 207*e* have a substantially uniform length in a direction perpendicular to the longitudinal direction of the stay 207 throughout the entire width in the longitudinal direction of the stay 207. Conversely, the first mount 207*d* is greater than the second mount 207*f* in the recording medium conveyance direction DS. The first partition 207*c* and the second partition 207*e* extend linearly in a longitudinal direction of the halogen heaters 202A and 202B. The first partition 207*c* contacts the second partition 207*e* to define the substantially T-shaped stay 207 in cross-section. However, the first partition 207*c* and the second partition 207*e* divide an interior of the fixing belt 201 into a first compartment 211 and a second compartment 212 that are different in size. For example, the first compartment 211 is greater in size than the second compartment 212 as shown in FIG. 4 illustrating the first compartment 211 and the second compartment 212.

As shown in FIG. 2, the two halogen heaters 202A and 202B are disposed in two different compartments defined by the stay 207, that is, the first compartment 211 serving as a downstream compartment and the second compartment 212 serving as an upstream compartment in the rotation direction D201 of the fixing belt 201, respectively. Accordingly, while the halogen heaters 202A and 202B are powered on, glass tubes of the halogen heaters 202A and 202B do not heat each other, preventing degradation in heating efficiency of the halogen heaters 202A and 202B. The halogen heater 202A serving as a first heater transferred with an increased amount of electric power to generate an increased amount of heat is disposed in the first compartment 211 inside the loop formed by the fixing belt 201 that is greater in size than the second compartment 212. Conversely, the halogen heater 202B serving as a second heater transferred with a decreased amount of electric power to generate a decreased amount of heat is disposed in the second compartment 212 inside the loop formed by the fixing belt 201 that is smaller in size than the first compartment 211.

Compared to the fourth comparative fixing device having the two even compartments inside the loop formed by the fixing belt, the fixing device 200 allows the halogen heater 202A transferred with the increased amount of electric power to generate the increased amount of heat to have an increased irradiation angle $\alpha$, thus increasing heating efficiency of the halogen heater 202A. Conversely, the fixing device 200 allows the halogen heater 202B transferred with the decreased amount of electric power to generate the decreased amount of heat to have a decreased irradiation angle $\beta$, thus decreasing heating efficiency of the halogen heater 202B. Accordingly, the fixing device 200 as a whole improves heating efficiency of the halogen heaters 202A and 202B compared to the fourth comparative fixing device having the two even compartments inside the loop formed by the fixing belt. Since the second compartment 212 accommodating the halogen heater 202B that generates the deceased amount of heat is smaller in size than the first compartment 211, the second compartment 212 renders the halogen heater 202B to have the decreased irradiation angle $\beta$ defined by light being radiated from the halogen heater 202B and irradiating the fixing belt 201, thus decreasing heating efficiency of the halogen heater 202B. However, the fixing device 200 as a whole enhances heating efficiency for heating the fixing belt 201.

In other words, since the stay 207 blocks light radiated from the two halogen heaters 202A and 202B disposed opposite each other via the stay 207, the fixing belt 201 is divided into an irradiation span where light from the halogen heaters 202A and 202B irradiates the fixing belt 201 and a non-irradiation span where light from the halogen heaters 202A and 202*b* does not irradiate the fixing belt 201 in a circumferential direction of the fixing belt 201. The irradiation span is divided into a first irradiation span where light from the halogen heater 202A disposed in the greater first compartment 211 irradiates the fixing belt 201 and a second irradiation span where light from the halogen heater 202B disposed in the smaller second compartment 212 irradiates the fixing belt 201. The first irradiation span is greater than the second irradiation span in the circumferential direction of the fixing belt 201. To address this circumstance, the halogen heater 202A that generates the increased amount of heat and is transferred with the increased amount of electric power is situated in the greater first compartment 211, enhancing overall heating efficiency of the fixing device 200 incorporating the two halogen heaters 202A and 202B.

Alternatively, the fixing device 200 may incorporate an additional component other than the stay 207 that is interposed between the halogen heaters 202A and 202B and the fixing belt 201 to screen the fixing belt 201 from the halogen heaters 202A and 202B. In this case also, the fixing device 200, incorporating the stay 207 designed by considering at least the non-irradiation span of the fixing belt 201 produced by the stay 207 so as to enhance heating efficiency of the halogen heaters 202A and 202B, increases flexibility in designing the shape and the position of the additional component disposed inside the loop formed by the fixing belt 201.

The fixing belt 201 may deform as the fixing belt 201 rotates or halts, for example. However, if the fixing device 200 achieves the configuration described above at least when the halogen heaters 202A and 202B are energized, the fixing device 200 attains the advantages described above. For example, the halogen heaters 202A and 202B include heat generators having different heating spans or different heat distributions in the longitudinal direction of the halogen heaters 202A and 202B, respectively. The halogen heaters 202A and 202B are disposed in different compartments defined by the stay 207, that is, the first compartment 211 and the second compartment 212, respectively. The halogen heater 202A to generate the increased amount of heat is situated in the greater first compartment 211. Conversely, the halogen heater 202B to generate the decreased amount of heat is situated in the smaller second compartment 212.

Figure 5:
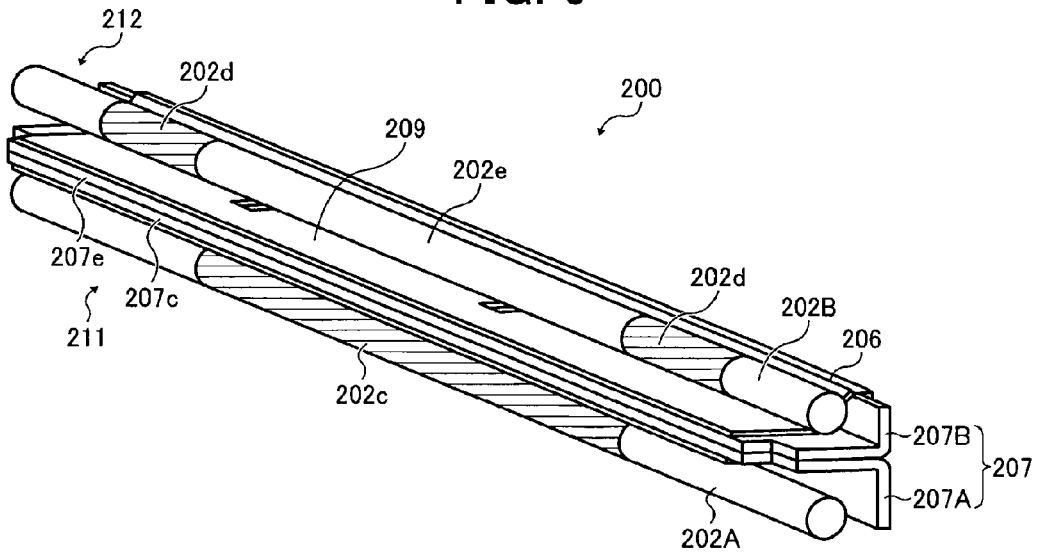
FIG. 5 is a partial schematic perspective view of the fixing device shown in FIG. 2 illustrating the interior of the loop formed by the fixing belt that is reversed vertically from the view shown in FIG. 4.

FIG. 4 is a partial schematic perspective view of the fixing device 200 illustrating the interior of the loop formed by the fixing belt 201. FIG. 5 is a partial schematic perspective view of the fixing device 200 illustrating the interior of the loop formed by the fixing belt 201 that is reversed vertically from the view shown in FIG. 4.

As shown in FIG. 4, the halogen heater 202A situated in the first compartment 211 is a center heater that heats a center span of the fixing belt 201 in the axial direction thereof. For example, the halogen heater 202A includes a heat generator 202*c* to generate heat as the halogen heater 202A is energized. The heat generator 202*c* serving as a first heat generator is disposed at a center span of the halogen heater 202A in the longitudinal direction thereof.

As shown in FIG. 5, the halogen heater 202B situated in the second compartment 212 is a lateral end heater that heats each lateral end span of the fixing belt 201 in the axial direction thereof. For example, the halogen heater 202B includes a heat generator 202*d* to generate heat as the halogen heater 202B is energized. The heat generator 202*d* serving as a second heat generator is disposed at each lateral end span of the halogen heater 202B in the longitudinal direction thereof and disposed outboard from the heat generator 202*c* in the longitudinal direction of the halogen heater 202B. While the halogen heater 202A is energized, a portion of the halogen heater 202A other than the heat generator 202*c*, that is, a non-heating portion 202*f* depicted in FIG. 4 disposed outboard from the heat generator 202*c* in the longitudinal direction of the halogen heater 202A, does not generate heat. Similarly, while the halogen heater 202B is energized, a portion of the halogen heater 202B other than the heat generator 202*d*, that is, a non-heating portion 202*e* depicted in FIG. 5 disposed inboard from the heat generator 202*d* in the longitudinal direction of the halogen heater 202B, does not generate heat.

The heat generator 202*c* of the halogen heater 202A and the heat generator 202*d* of the halogen heater 202B have different heating spans or different heat distributions in the longitudinal direction of the halogen heaters 202A and 202B, respectively. For example, the heat generator 202*d* of the halogen heater 202B is outboard from the heat generator 202*c* of the halogen heater 202A in the longitudinal direction of the halogen heaters 202A and 202B. That is, the heat generator 202*d* of the halogen heater 202B does not overlap the heat generator 202*c* of the halogen heater 202A in the longitudinal direction of the halogen heaters 202A and 202B.

As shown in FIG. 4, the reflector 209 is interposed between the stay 207 and the heat generator 202*c* of the halogen heater 202A. As shown in FIG. 5, the reflector 209 is interposed between the stay 207 and the heat generators 202*d* of the halogen heater 202B.

For example, the heat generator 202*c* has a length of 217 mm in the longitudinal direction of the halogen heater 202A. The halogen heater 202A is transferred with an amount of electric power of 770 W. Each of the two heat generators 202*d* has a length of 63 mm in the longitudinal direction of the halogen heater 202B to produce a combined length of the two heat generators 202*d* of 126 mm. The halogen heater 202B is transferred with an amount of electric power of 440 W. In a print job for printing on a recording medium S of an A4 size sheet in landscape orientation or an A3 size sheet in portrait orientation that has a width of 297 mm in the axial direction of the fixing belt 201, the halogen heaters 202A and 202B are powered on.

The amount of heat generated by the center halogen heater 202A and the amount of electric power transferred to the center halogen heater 202A are greater than the amount of heat generated by the lateral end halogen heater 202B and the amount of electric power transferred to the lateral end halogen heater 202B. However, the amount of heat generated by each of the halogen heaters 202A and 202B and the amount of electric power transferred to the halogen heaters 202A and 202B per unit length in the longitudinal direction thereof are 3.5 W/mm, for example. It is to achieve a constant amount of heat conducted to the recording medium S and the toner image T on the recording medium S so as to retain a predetermined fixing property to fix the toner image T on the recording medium S properly and glossiness of the toner image T on the recording medium S.

As shown in FIG. 2, the irradiation angle $\alpha$ of the halogen heater 202A having the wide heat generator 202*c* greater than the narrow heat generator 202*d* of the halogen heater 202B in the longitudinal direction thereof is greater than the irradiation angle $\beta$ of the halogen heater 202B having the narrow heat generator 202*d* so as to improve a combined heating efficiency of the halogen heaters 202A and 202B. In other words, in a cross-section perpendicular to the longitudinal direction of the halogen heaters 202A and 202B shown in FIG. 2, the irradiation angle $\alpha$ defined by light being radiated from the heat generator 202*c* of the halogen heater 202A that generates the increased amount of heat and irradiating the fixing belt 201 directly is greater than the irradiation angle $\beta$ defined by light being radiated from the heat generator 202*d* of the halogen heater 202B that generates the decreased amount of heat and irradiating the fixing belt 201 directly. Such configuration is applicable to exemplary embodiments described below.

For example, if the irradiation angle $\alpha$ of the halogen heater 202A increases by 5 percent and therefore the irradiation angle $\beta$ of the halogen heater 202B decreases by 5 percent, amounts of electric power PA, PB, and PC based on an amount of electric power of the fourth comparative fixing device having the two even compartments inside the loop formed by the fixing belt are calculated theoretically by formulas (1), (2), and (3) as below.

$$PA = 770\ \text{W} \times 1.05 = 808.5\ \text{W} \quad (1)$$

In the formula (1), PA represents an amount of electric power of the halogen heater 202A.

$$PB = 440\ \text{W} \times 0.95 = 418.0\ \text{W} \quad (2)$$

In the formula (2), PB represents an amount of electric power of the halogen heater 202B.

$$PC=808.5\ \text{W}+418.0\ \text{W}=1226.5\ \text{W} \quad (3)$$

In the formula (3), PC represents a combined amount of electric power of the halogen heaters 202A and 202B.

Conversely, if the halogen heaters 202A and 202B are situated in the two even compartments inside the loop formed by the fixing belt 201, respectively, and have an identical irradiation angle, the amounts of electric power PA, PB, and PC based on the amount of electric power of the fourth comparative fixing device having the two even compartments inside the loop formed by the fixing belt are calculated by formulas (4), (5), and (6) as below.

$$PA=770\ \text{W} \quad (4)$$

$$PB=440\ \text{W} \quad (5)$$

$$PC=770\ \text{W}+440\ \text{W}=1210\ \text{W} \quad (6)$$

As described above, increase in heating efficiency of the halogen heater 202A having the wide heat generator 202*c* is greater than decrease in heating efficiency of the halogen heater 202B. Accordingly, the combined heating efficiency of the halogen heaters 202A and 202B of the fixing device 200 improves compared to heating efficiency of the fourth comparative fixing device having the two even compartments inside the loop formed by the fixing belt.

A description is provided of a configuration of a fixing device 200S according to a second exemplary embodiment.

Figure 6:
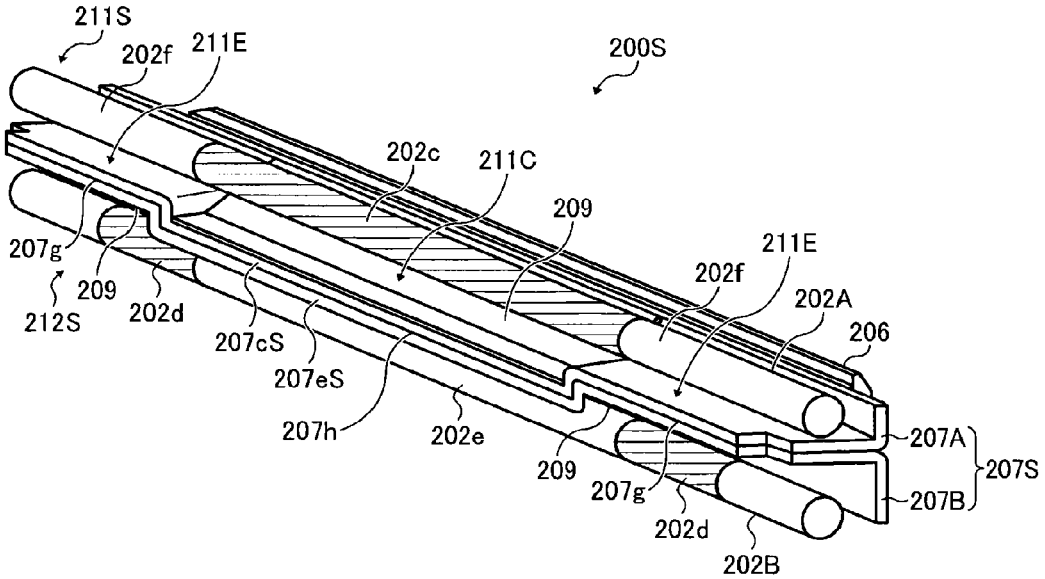
FIG. 6 is a partial schematic perspective view of a fixing device according to a second exemplary embodiment of the present disclosure illustrating the interior of the loop formed by the fixing belt.
Figure 7:
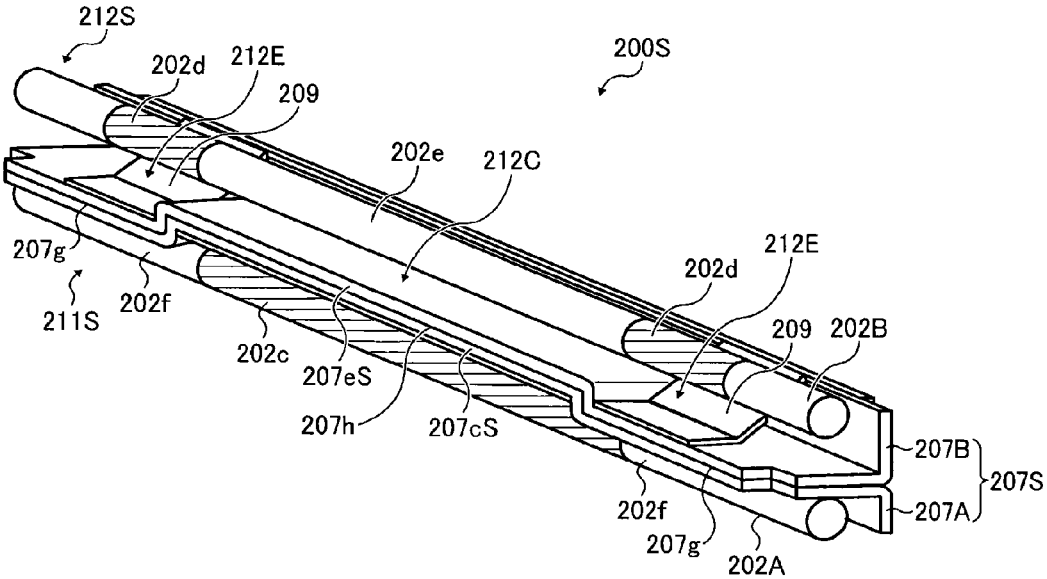
FIG. 7 is a partial schematic perspective view of the fixing device shown in FIG. 6 illustrating the interior of the loop formed by the fixing belt that is reversed vertically from the view shown in FIG. 6.
Figure 8:
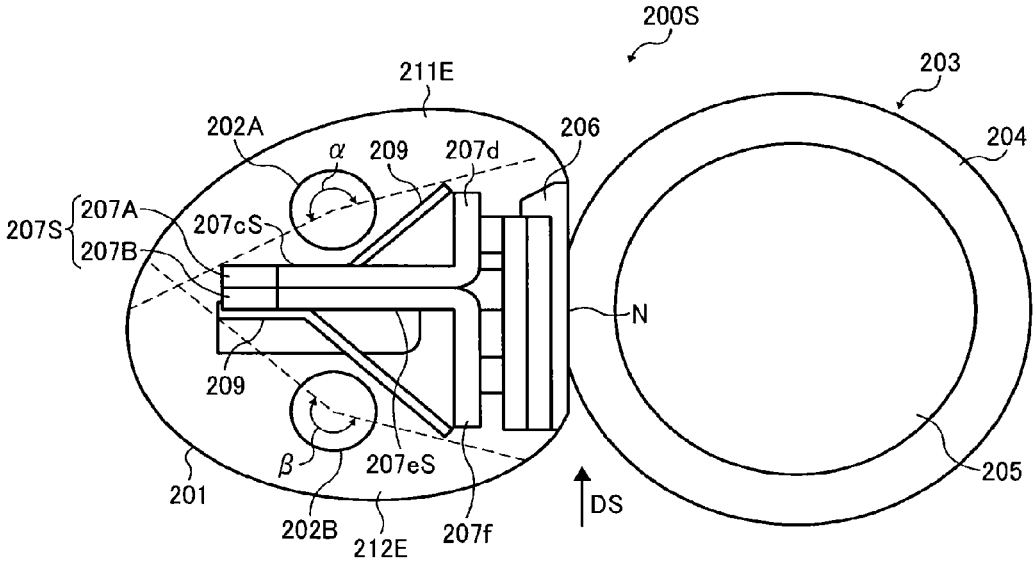
FIG. 8 is a schematic vertical sectional view of the fixing device shown in FIG. 6 at a lateral end of the fixing device in a longitudinal direction thereof.
Figure 9:
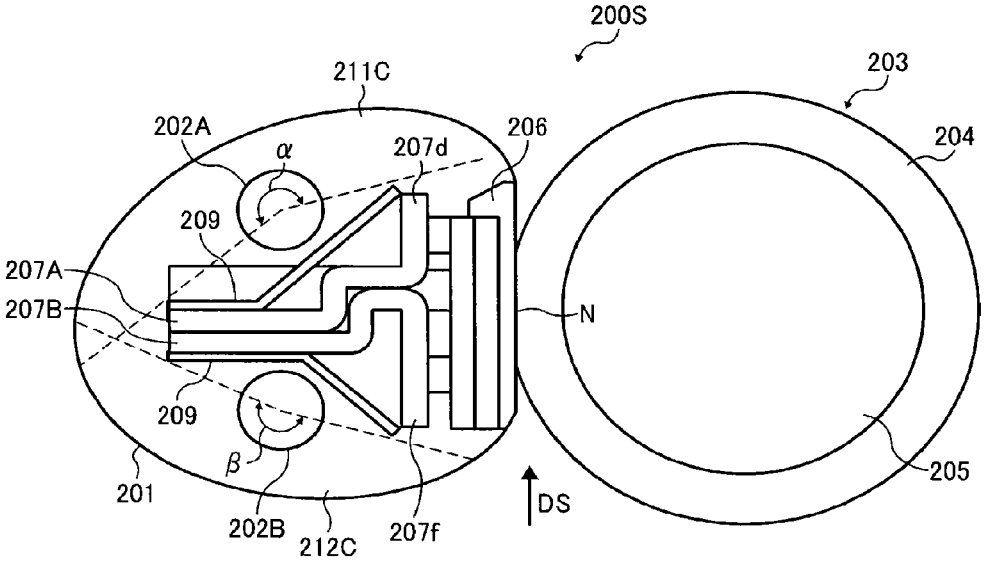
FIG. 9 is a schematic vertical sectional view of the fixing device shown in FIG. 6 at a center of the fixing device in the longitudinal direction thereof.

FIG. 6 is a partial schematic perspective view of the fixing device 200S illustrating the interior of the loop formed by the fixing belt 201. FIG. 7 is a partial schematic perspective view of the fixing device 200S illustrating the interior of the loop formed by the fixing belt 201 that is reversed vertically from the view shown in FIG. 6. FIG. 8 is a schematic vertical sectional view of the fixing device 200S shown in FIG. 6 at a lateral end of the fixing device 200S in a longitudinal direction thereof. FIG. 9 is a schematic vertical sectional view of the fixing device 200S shown in FIG. 6 at a center of the fixing device 200S in the longitudinal direction thereof. The following describes a construction of the fixing device 200S according to the second exemplary embodiment that is different from the construction of the fixing device 200 according to the first exemplary embodiment described above.

Like the fixing device 200 depicted in FIG. 4, the fixing device 200S depicted in FIG. 6 includes the two halogen heaters 202A and 202B. The heat generator 202*c* of the halogen heater 202A and the heat generator 202*d* of the halogen heater 202B have different heating spans or different heat distributions in the longitudinal direction of the halogen heaters 202A and 202B, respectively. For example, the heat generator 202*d* of the halogen heater 202B is outboard from the heat generator 202*c* of the halogen heater 202A in the longitudinal direction of the halogen heaters 202A and 202B. The two halogen heaters 202A and 202B are disposed in two different compartments defined by a stay 207S serving as a partition, that is, a first compartment 211S serving as a downstream compartment and a second compartment 212S serving as an upstream compartment in the rotation direction D201 of the fixing belt 201, respectively. Accordingly, while the halogen heaters 202A and 202B are powered on, the glass tubes of the halogen heaters 202A and 202B do not heat each other, preventing degradation in heating efficiency of the halogen heaters 202A and 202B.

The size of the first compartment 211S accommodating the halogen heater 202A and the second compartment 212S accommodating the halogen heater 202B varies depending on the length of the heat generators 202*c* and 202*d* in the longitudinal direction of the halogen heaters 202A and 202B. For example, a part of the first compartment 211S where the heat generator 202*c* of the halogen heater 202A is disposed increases in accordance with the length of the heat generator 202*c* in the longitudinal direction of the halogen heater 202A. Similarly, a part of the second compartment 212S where the heat generator 202*d* of the halogen heater 202B is disposed increases in accordance with the length of the heat generator 202*d* in the longitudinal direction of the halogen heater 202B. Accordingly, the shape of the stay 207S varies in a longitudinal direction thereof.

For example, the stay 207S includes a first partition 207*c*S and a second partition 207*e*S. Each of the first partition 207*c*S and the second partition 207*e*S includes a center partition portion 207*h* serving as a first partition portion disposed opposite the heat generator 202*c* of the halogen heater 202A and a lateral end partition portion 207*g* serving as a second partition portion disposed opposite the heat generator 202*d* of the halogen heater 202B.

As shown in FIGS. 6 and 7, the center partition portion 207*h* is disposed opposite the heat generator 202*c* of the halogen heater 202A with an increased interval therebetween and disposed opposite the non-heating portion 202*e* of the halogen heater 202B with a decreased interval therebetween. Conversely, the lateral end partition portion 207*g* is disposed opposite the heat generator 202*d* of the halogen heater 202B with an increased interval therebetween and disposed opposite the non-heating portion 202*f* of the halogen heater 202A with a decreased interval therebetween. In other words, as shown in FIG. 6, the first compartment 211S includes a center section 211C serving as a first increased size section accommodating the heat generator 202*c* of the halogen heater 202A that generates the increased amount of heat and a lateral end section 211E serving as a first decreased size section accommodating each non-heating portion 202*f* of the halogen heater 202A. The center section 211C disposed inboard from the lateral end section 211E in the longitudinal direction of the halogen heater 202A is greater in size than the lateral end section 211E.

As shown in FIG. 7, the second compartment 212S includes a center section 212C serving as a second decreased size section accommodating the non-heating portion 202*e* of the halogen heater 202B that generates the decreased amount of heat and a lateral end section 212E serving as a second increased size section accommodating each heat generator 202*d* of the halogen heater 202B. The lateral end section 212E disposed outboard from the center section 212C in the longitudinal direction of the halogen heater 202B is greater in size than the center section 212C. Accordingly, as shown in FIG. 8 illustrating the lateral end of the fixing device 200S in the longitudinal direction thereof, the lateral end section 212E of the second compartment 212S that accommodates the heat generator 202*d* of the halogen heater 202B is greater in size than the lateral end section 211E of the first compartment 211S that accommodates the non heat generator non-heating portion 202*f* of the halogen heater 202A and is disposed opposite the lateral end section 212E of the second compartment 212S via the stay 207S. The second compartment 212S accommodating the halogen heater 202B that generates the deceased amount of heat is also upsized to increase the irradiation angle β defined by light being radiated from the halogen heater 202B that generates the decreased amount of heat and irradiating the fixing belt 201, thus increasing heating efficiency of the halogen heater 202B. Hence, the fixing device 200S enhances heating efficiency for heating the fixing belt 201.

The irradiation angle β of the halogen heater 202B increases by 5 percent, for example, at the lateral end of the fixing device 200S in the longitudinal direction thereof shown in FIG. 8. Conversely, the irradiation angle α of the halogen heater 202A decreases by 5 percent, for example. However, since each lateral end span of the halogen heater 202A in the longitudinal direction thereof constitutes the non-heating portion 202*f*, light or heat radiated from the halogen heater 202A does not decrease. The irradiation angle β of the halogen heater 202B decreases by 5 percent, for example, at the center of the fixing device 200S in the longitudinal direction thereof shown in FIG. 9. Conversely, the irradiation angle α of the halogen heater 202A increases by 5 percent, for example. However, since a center span of the halogen heater 202B in the longitudinal direction thereof constitutes the non-heating portion 202*e*, light or heat radiated from the halogen heater 202B does not decrease. Accordingly, the irradiation angles α and β of the two halogen heaters 202A and 202B, respectively, increase, enhancing heating efficiency of the halogen heaters 202A and 202B. Hence, the fixing device 200S as a whole enhances heating efficiency for heating the fixing belt 201 compared to the fixing device 200 depicted in FIG. 2.

For example, the heat generator 202*c* has a length of 217 mm in the longitudinal direction of the halogen heater 202A. The halogen heater 202A is transferred with an amount of electric power of 770 W. Each of the two heat generators 202*d* has a length of 63 mm in the longitudinal direction of the halogen heater 202B to produce a combined length of the two heat generators 202*d* of 126 mm. The halogen heater 202B is transferred with an amount of electric power of 440 W.

However, the amount of heat generated by each of the halogen heaters 202A and 202B and the amount of electric power transferred to the halogen heaters 202A and 202B per unit length in the longitudinal direction thereof are 3.5 W/mm, for example. It is to achieve the constant amount of heat conducted to the recording medium S and the toner image T on the recording medium S so as to retain the predetermined fixing property to fix the toner image T on the recording medium S properly and glossiness of the toner image T on the recording medium S.

For example, if the irradiation angle α of the halogen heater 202A and the irradiation angle β of the halogen heater 202B increase by 5 percent, the amounts of electric power PA, PB, and PC based on the amount of electric power of the fourth comparative fixing device having the two even compartments inside the loop formed by the fixing belt are calculated theoretically by formulas (7), (8), and (9) as below.

$$PA=770\ \text{W}\times1.05=808.5\ \text{W} \tag{7}$$

$$PB=440\ \text{W}\times1.05=462.0\ \text{W} \tag{8}$$

$$PC=808.5\ \text{W}+462.0\ \text{W}=1270.5\ \text{W} \tag{9}$$

Thus, according to the second exemplary embodiment, the irradiation angles α and β of the heat generators 202*c* and 202*d* of the two halogen heaters 202A and 202B, respectively, increase, enhancing heating efficiency of the halogen heaters 202A and 202B compared to the first exemplary embodiment described above.

A description is provided of a configuration of a fixing device 200T according to a third exemplary embodiment.

As described above with reference to the fixing device 200 according to the first exemplary embodiment shown in FIGS. 2 to 5, even if one of the irradiation angles α and β of the halogen heaters 202A and 202B, respectively, decreases, another one of the irradiation angles α and β of the halogen heaters 202A and 202B, respectively, increases, enhancing heating efficiency of the halogen heaters 202A and 202B as a whole. Hence, the fixing device 200T according to the third exemplary embodiment increases the irradiation angle α of the halogen heater 202A that generates the increased amount of heat and is transferred with the increased amount of electric power. In this case, the fixing device 200T has a cross-section shown in FIG. 2 at a center of the fixing device 200T in a longitudinal direction thereof and a cross-section shown in FIG. 10 at a lateral end of the fixing device 200T in the longitudinal direction thereof.

Figure 10:
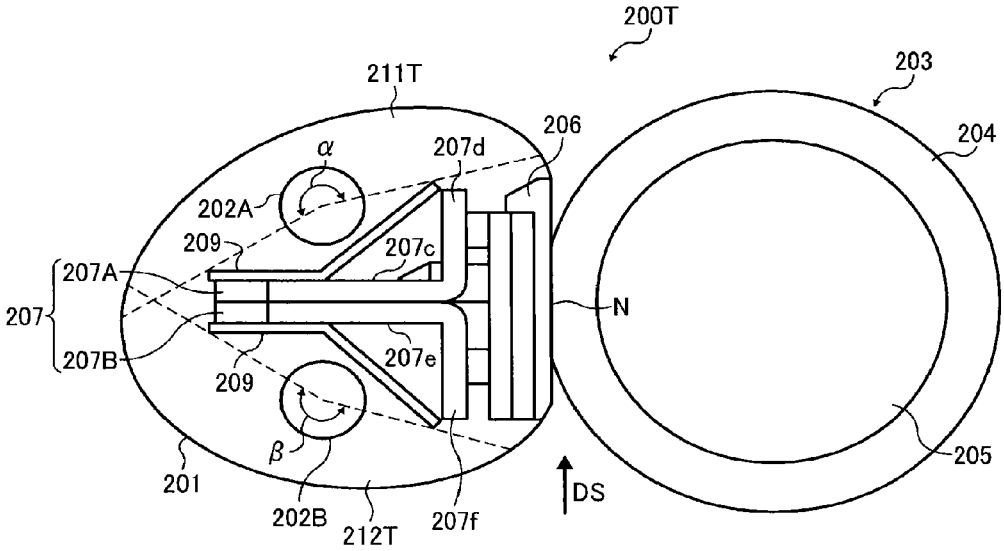
FIG. 10 is a schematic vertical sectional view of a fixing device according to a third exemplary embodiment of the present disclosure at a lateral end of the fixing device in a longitudinal direction thereof.

FIG. 10 is a schematic vertical sectional view of the fixing device 200T. For example, the center section 211C of a first compartment 211T that accommodates the heat generator 202*c* of the halogen heater 202A that generates the increased amount of heat is greater in size than the lateral end section 211E of the first compartment 211T that does not accommodate the heat generator 202*c*. The lateral end section 212E of a second compartment 212T that accommodates the heat generator 202*d* of the halogen heater 202B generating the decreased amount of heat is substantially equivalent in size to the lateral end section 211E of the first compartment 211T that accommodates the non-heating portion 202*f* of the halogen heater 202A generating the increased amount of heat and is disposed opposite the lateral end section 212E of the second compartment 212T via the stay 207.

As shown in FIG. 2, the irradiation angle α of the halogen heater 202A increases by 5 percent, for example, in the center span of the halogen heater 202A in the longitudinal direction thereof where the heat generator 202*c* is disposed. Therefore, the irradiation angle β of the halogen heater 202B decreases by 5 percent. However, since the heat generator 202*d* of the halogen heater 202B is not disposed in the center span of the halogen heater 202B in the longitudinal direction thereof, the irradiation angle β of the halogen heater 202B decreases.

In this case, the amounts of electric power PA, PB, and PC based on the amount of electric power of the fourth comparative fixing device having the two even compartments inside the loop formed by the fixing belt are calculated theoretically by formulas (10), (11), and (12) as below.

$$PA=770\ \text{W}\times1.05=808.5\ \text{W} \tag{10}$$

$$PB=440\ \text{W}\times1.00=440.0\ \text{W} \tag{11}$$

$$PC=808.5\ \text{W}+440.0\ \text{W}=1248.5\ \text{W} \tag{12}$$

Thus, according to the third exemplary embodiment, the irradiation angle α of the halogen heater 202A that generates the increased amount of heat and is transferred with the increased amount of electric power increases, enhancing heating efficiency of the halogen heaters 202A and 202B compared to the first exemplary embodiment described above.

A description is provided of a configuration of a fixing device 200U according to a fourth exemplary embodiment.

Figure 11:
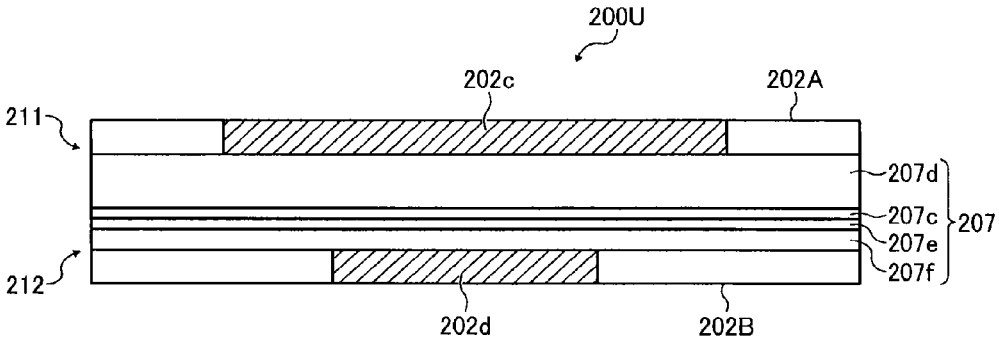
FIG. 11 is a schematic diagram of a fixing device according to a fourth exemplary embodiment of the present disclosure.

FIG. 11 is a schematic diagram of the fixing device 200U. As shown in FIG. 11, the halogen heater 202A of the fixing device 200U includes the heat generator 202*c* spanning a width of a large recording medium S in the longitudinal direction of the halogen heater 202A. The halogen heater 202B of the fixing device 200U includes the heat generator

202*d* spanning a width of a small recording medium S in the longitudinal direction of the halogen heater 202B. For example, the width of the large recording medium S is a width of an A4 size sheet in landscape orientation or a width of an A3 size sheet in portrait orientation. The width of the small recording medium S is a width of an A4 size sheet in portrait orientation or a width of a B5 size sheet in portrait orientation.

Like the fixing device 200 depicted in FIG. 4, the fixing device 200U depicted in FIG. 11 includes the two halogen heaters 202A and 202B. The heat generator 202*c* of the halogen heater 202A and the heat generator 202*d* of the halogen heater 202B have different heating spans or different heat distributions in the longitudinal direction of the halogen heaters 202A and 202B, respectively. The heat generator 202*c* of the halogen heater 202A overlaps the heat generator 202*d* of the halogen heater 202B in the longitudinal direction of the halogen heaters 202A and 202B. The two halogen heaters 202A and 202B are disposed in two different compartments defined by the stay 207, that is, the first compartment 211 serving as a downstream compartment and the second compartment 212 serving as an upstream compartment in the rotation direction D201 of the fixing belt 201, respectively. Accordingly, while the halogen heaters 202A and 202B are powered on, the glass tubes of the halogen heaters 202A and 202B do not heat each other, preventing degradation in heating efficiency of the halogen heaters 202A and 202B.

The stay 207 of the fixing device 200U is equivalent to the stay 207 of the fixing device 200 shown in FIG. 2. For example, the first partition 207*c* of the first part 207A of the stay 207 and the second partition 207*e* of the second part 207B of the stay 207 have a substantially uniform length in the direction perpendicular to the longitudinal direction of the stay 207 throughout the entire width in the longitudinal direction of the stay 207. Conversely, the first mount 207*d* is greater than the second mount 207*f* in the recording medium conveyance direction DS. The first partition 207*c* and the second partition 207*e* extend linearly in the longitudinal direction of the halogen heaters 202A and 202B. The fixing device 200U has a cross-section at a center of the fixing device 200U in a longitudinal direction thereof that is equivalent to the cross-section of the fixing device 200 shown in FIG. 2. FIG. 11 omits illustration of the reflector 209 shown in FIG. 2.

Overall, the first compartment 211 is greater in size than the second compartment 212 inside the loop formed by the fixing belt 201. Since the halogen heater 202A that generates the increased amount of heat and is transferred with the increased amount of electric power attains the increased irradiation angle α and therefore increases heating efficiency, the halogen heater 202B that generates the decreased amount of heat and is transferred with the decreased amount of electric power attains the decreased irradiation angle β, decreasing heating efficiency. Accordingly, the fixing device 200U as a whole improves heating efficiency of the halogen heaters 202A and 202B compared to the fourth comparative fixing device having the two even compartments inside the loop formed by the fixing belt.

As described above, a compartment accommodating the halogen heater 202A that generates the increased amount of heat (e.g., the first compartments 211, 211S, and 211T) is greater in size than another compartment accommodating the halogen heater 202B that generates the decreased amount of heat (e.g., the second compartments 212, 212S, and 212T) to render the irradiation angle α defined by light being radiated from the halogen heater 202A and irradiating the fixing belt 201 to be greater than the irradiation angle β defined by light being radiated from the halogen heater 202B and irradiating the fixing belt 201, thus increasing heating efficiency of the halogen heaters 202A and 202B.

Each of the fixing devices 200, 200S, 200T, and 200U includes two heaters, that is, the halogen heaters 202A and 202B. However, the number of the heaters is not limited to two. For example, each of the fixing devices 200, 200S, 200T, and 200U may incorporate three heaters including heat generators spanning different heating spans or having different heat distributions, respectively, in a longitudinal direction of the heaters. The three heaters may be situated in three different compartments defined by a support (e.g., a stay), respectively. The amount of heat generated by the three heaters is proportional to the size of the three compartments accommodating the three heaters, respectively.

As shown in FIGS. 2 and 8, the stay (e.g., the stays 207 and 207S) is T-shaped in cross-section. Alternatively, since the stay supports the nip formation pad 206 against pressure from the pressure roller 203, the stay may include the first partition 207*c* or 207*c*S and the second partition 207*e* or 207*e*S, not including the first mount 207*d* and the second mount 207*f*, and therefore may be I-shaped.

A description is provided of advantages of the fixing devices 200, 200S, 200T, and 200U.

As shown in FIGS. 2, 8, 10, and 11, a fixing device (e.g., the fixing devices 200, 200S, 200T, and 200U) includes a fixing rotator (e.g., the fixing belt 201) rotatable in a predetermined direction of rotation (e.g., the rotation direction D201); a pressure rotator (e.g., the pressure roller 203) disposed opposite the fixing rotator and rotatable in a predetermined direction of rotation (e.g., the rotation direction D203); a plurality of heaters (e.g., the halogen heaters 202A and 202B) disposed inside the fixing rotator to heat the fixing rotator; a nip formation pad (e.g., the nip formation pad 206) pressing against the pressure rotator via the fixing rotator to form the fixing nip N between the fixing rotator and the pressure rotator; and a support (e.g., the stays 207 and 207S) supporting the nip formation pad. As a recording medium S bearing a toner image T is conveyed through the fixing nip N, the fixing rotator and the pressure rotator fix the toner image T on the recording medium S.

As shown in FIGS. 4, 6, 10, and 11, the plurality of heaters includes a first heater (e.g., the halogen heater 202A) that generates an increased amount of heat and includes a first heat generator (e.g., the heat generator 202*c*) spanning a first heating span in a longitudinal direction of the first heater and a second heater (e.g., the halogen heater 202B) that generates a decreased amount of heat and includes a second heat generator (e.g., the heat generator 202*d*) spanning a second heating span in a longitudinal direction of the second heater. The support defines a first compartment (e.g., the first compartments 211, 211S, and 211T) accommodating the first heater and a second compartment (e.g., the second compartments 212, 212S, and 212T) accommodating the second heater. The first compartment is greater in size than the second compartment.

Accordingly, even if the fixing device employs the plurality of heaters that has different heating spans or different heat distributions in the longitudinal direction thereof, respectively, one of the heaters does not heat another one of the heaters with radiation heat, preventing degradation in heating efficiency of the heaters. The support does not define the first compartment and the second compartment evenly to merely locate the first heater and the second heater via the support, thus further improving heating efficiency of the heaters.

The fixing device employing the plurality of heaters that has the different heating spans or the different irradiation spans in the longitudinal direction thereof, respectively, improves heating efficiency of the heaters, shortening the first print time and enhancing fixing property of fixing the toner image on the recording medium properly.

According to the exemplary embodiments described above, the fixing belt 201 serves as a fixing rotator. Alternatively, a fixing roller, a fixing film, a fixing sleeve, or the like may be used as a fixing rotator. Further, the pressure roller 203 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a fixing rotator rotatable in a predetermined direction of rotation;

a pressure rotator disposed opposite the fixing rotator to form a fixing nip therebetween, through which a recording medium bearing a toner image is conveyed;

a first heater disposed inside the fixing rotator to generate a first amount of heat to heat the fixing rotator, the first heater including a first heat generator having a first heating span in a longitudinal direction of the first heater;

a second heater disposed inside the fixing rotator to generate a second amount of heat to heat the fixing rotator, the second amount of heat being less than the first amount of heat, and the second heater including a second heat generator having a second heating span in a longitudinal direction of the second heater; and a partition interposed between the first heater and the second heater to define a first compartment having a first size and accommodating the first heater and a second compartment having a second size and accommodating the second heater, the second size being less than the first size, wherein the partition includes a first part and a second part each with a substantially L-shape, the first part and the second part contacting at a central portion of the partition, the first part including a first mount substantially perpendicular to the central portion, the second part including a second mount substantially perpendicular to the central portion, and the first mount has a length greater than a length of the second mount in a recording medium conveyance direction, wherein an entirety of light being radiated from the first heat generator of the first heater and irradiating the fixing rotator directly defines a first irradiation angle in a cross-section perpendicular to the longitudinal direction of the first heater and the second heater, wherein an entirety of light being radiated from the second heat generator of the second heater and irradiating the fixing rotator directly defines a second irradiation angle in the cross-section perpendicular to the longitudinal direction of the first heater and the second heater, and wherein the first irradiation angle is greater than the second irradiation angle.

2. The fixing device according to claim 1, wherein the first compartment includes:

a first increased size section accommodating the first heat generator of the first heater; and a first decreased size section disposed outboard from the first increased size section in the longitudinal direction of the first heater and smaller in size than the first increased size section.

3. The fixing device according to claim 2, wherein the second compartment includes:

a second increased size section accommodating the second heat generator of the second heater; and a second decreased size section disposed inboard from the second increased size section in the longitudinal direction of the second heater and smaller in size than the second increased size section.

4. The fixing device according to claim 3, wherein the first decreased size section of the first compartment is substantially equivalent in size to the second increased size section of the second compartment.

5. The fixing device according to claim 1, wherein the first heater further includes a first non-heating portion disposed outboard from the first heat generator in the longitudinal direction of the first heater, and wherein the second heater further includes a second non-heating portion disposed inboard from the second heat generator in the longitudinal direction of the second heater.

6. The fixing device according to claim 5, wherein the first part is disposed opposite the first heat generator of the first heater with a first interval therebetween; and wherein the second part is disposed opposite the second non-heating portion of the second heater with a second interval therebetween, the second interval being less than the first interval.

7. The fixing device according to claim 1, wherein the partition extends linearly in the longitudinal direction of the first heater and the second heater.

8. The fixing device according to claim 1, further comprising a first reflector and a second reflector interposed between the partition and each of the first heat generator of the first heater and the second heat generator of the second heater, the first reflector and the second reflector to reflect light radiated from the first heat generator of the first heater and the second heat generator of the second heater respectively toward the fixing rotator.

9. The fixing device according to claim 1, wherein the first heat generator of the first heater is disposed opposite a center span of the fixing rotator in an axial direction thereof, and wherein the second heat generator of the second heater is disposed opposite a lateral end span of the fixing rotator in the axial direction thereof.

10. The fixing device according to claim 1, wherein the fixing rotator includes an endless belt.

11. The fixing device according to claim 10, further comprising a nip formation pad to press against the pressure rotator via the endless belt to form the fixing nip.

12. The fixing device according to claim 11, wherein the partition supports the nip formation pad.

13. The fixing device according to claim 1, wherein the second heat generator of the second heater is disposed outboard from the first heat generator of the first heater.

14. The fixing device according to claim 1, wherein the first heat generator of the first heater overlaps the second heat generator of the second heater.

15. The fixing device according to claim 1, wherein the pressure rotator includes a pressure roller.

16. The fixing device according to claim 1, wherein:

the fixing rotator further defines an interior area, the partition divides the interior area of the fixing rotator into the first compartment and the second compartment having the first size and the second size, which is less than the first size, and the partition is mounted at an off-center position in relation to the fixing nip.

17. The fixing device according to claim 1, wherein a length of the first heat generator is greater than a length of the second heat generator in the longitudinal direction of the first heater and the second heater.

18. A fixing device comprising:

a fixing rotator rotatable in a predetermined direction of rotation;

a pressure rotator disposed opposite the fixing rotator to form a fixing nip therebetween, through which a recording medium bearing a toner image is conveyed;

a first heater disposed inside the fixing rotator to generate a first amount of heat to heat the fixing rotator, the first heater including a first heat generator having a first heating span in a longitudinal direction of the first heater;

a second heater disposed inside the fixing rotator to generate a second amount of heat to heat the fixing rotator, the second amount of heat being less than the first amount of heat, and the second heater including a second heat generator having a second heating span in a longitudinal direction of the second heater; and a partition interposed between the first heater and the second heater to define a first compartment having a first size and accommodating the first heater and a second compartment having a second size and accommodating the second heater, the second size being less than the first size, wherein the first heater and the second heater generate an identical amount of heat per unit length in the longitudinal direction of the first heater and the second heater, and wherein a length of the first heat generator is greater than a length of the second heat generator in the longitudinal direction of the first heater and the second heater.

19. An image forming apparatus comprising:

an image bearer to bear a toner image; and a fixing device disposed downstream from the image bearer in a recording medium conveyance direction to fix the toner image on a recording medium, the fixing device including:

a fixing rotator rotatable in a predetermined direction of rotation;

a pressure rotator disposed opposite the fixing rotator to form a fixing nip therebetween, through which the recording medium bearing the toner image is conveyed;

a first heater disposed inside the fixing rotator to generate a first amount of heat to heat the fixing rotator, the first heater including a first heat generator having a first heating span in a longitudinal direction of the first heater;

a second heater disposed inside the fixing rotator to generate a second amount of heat to heat the fixing rotator, the second amount of heat being less than the first amount of heat, and the second heater including a second heat generator having a second heating span in a longitudinal direction of the second heater; and a partition interposed between the first heater and the second heater to define a first compartment having a first size and accommodating the first heater and a second compartment having a second size and accommodating the second heater, the second size being less than the first size, wherein the partition includes a first part and a second part each with a substantially L-shape, the first part and the second part contacting at a central portion of the partition, the first part including a first mount substantially perpendicular to the central portion, the second part including a second mount substantially perpendicular to the central portion, and the first mount has a length greater than a length of the second mount in a recording medium conveyance direction, wherein an entirety of light being radiated from the first heat generator of the first heater and irradiating the fixing rotator directly defines a first irradiation angle in a cross-section perpendicular to the longitudinal direction of the first heater and the second heater, wherein an entirety of light being radiated from the second heat generator of the second heater and irradiating the fixing rotator directly defines a second irradiation angle in the cross-section perpendicular to the longitudinal direction of the first heater and the second heater, and wherein the first irradiation angle is greater than the second irradiation angle.

* * * * *